US006133553A

United States Patent [19]

Gärtner et al.

[11] Patent Number: 6,133,553

[45] Date of Patent: Oct. 17, 2000

[54] GODET FOR ADVANCING, GUIDING, AND HEATING AN ADVANCING SYNTHETIC FILAMENT YARN

[75] Inventors: Jürgen Gärtner, Remscheid; Uwe Baader, Wuppertal, both of Germany

[73] Assignee: Barmag AG, Remscheid, Germany

[21] Appl. No.: 09/009,033

[22] Filed: Jan. 20, 1998

[30] Foreign Application Priority Data

Jan. 20, 1997 [DE] Germany ..... 197 01 734

[51] Int. Cl.[7] ..... B21B 27/06; D02J 1/22

[52] U.S. Cl. ..... 219/469; 28/240

[58] Field of Search ..... 219/469, 470, 219/471, 388 S, 388, 619; 28/240; 492/46; 432/60, 228

[56] References Cited

U.S. PATENT DOCUMENTS

| | | | |
|---|---|---|---|
| 3,420,983 | 1/1969 | McCard et al. | 219/388 |
| 3,448,233 | 6/1969 | Landis . | |
| 3,581,060 | 5/1971 | Bauer et al. . | |
| 3,648,522 | 3/1972 | Haeli et al. | 73/351 |
| 3,732,395 | 5/1973 | David | 219/388 |
| 3,805,020 | 4/1974 | Bates | 219/469 |
| 4,533,808 | 8/1985 | Newman | 219/10.49 |
| 4,880,961 | 11/1989 | Duncan | 219/388 |
| 5,142,754 | 9/1992 | Krenzer | 28/271 |
| 5,159,166 | 10/1992 | Arnosti et al. | 219/10.492 |
| 5,241,159 | 8/1993 | Chatteriee et al. | 219/470 |
| 5,254,070 | 10/1993 | Callhoff . | |
| 5,421,070 | 6/1995 | Lenk . | |
| 5,553,443 | 9/1996 | St. Clair et al. | 53/450 |
| 5,624,593 | 4/1997 | Martens | 219/619 |
| 5,862,436 | 1/1999 | Ishizawa et al. | 399/69 |

FOREIGN PATENT DOCUMENTS

| | | |
|---|---|---|
| 1 694 542 U | of 0000 | Germany . |
| 195 32 036 | of 0000 | Germany . |

*Primary Examiner*—Teresa Walberg
*Assistant Examiner*—Daniel Robinson
*Attorney, Agent, or Firm*—Alston & Bird LLP

[57] ABSTRACT

A godet for advancing, guiding, and heating an advancing synthetic filament yarn, which includes a rotating godet casing, which is cup shaped and is mounted over a stationary, tubular support. In the space formed between the godet casing and the support, a radiation heater is arranged on the circumference of the support, and the radiation heater is formed by a heating coil which is wound about the support with a plurality of windings. The coil has over its length different spacings between adjacent windings to provide non-uniform heating along the length of the casing and thereby compensate for the non-uniform cooling of the casing which naturally occurs.

17 Claims, 4 Drawing Sheets

GODET FOR ADVANCING, GUIDING, AND HEATING AN ADVANCING SYNTHETIC FILAMENT YARN

BACKGROUND OF THE INVENTION

The present invention relates to a godet used for advancing, guiding, and heating an advancing synthetic filament yarn during the processing of the yarn. A godet of this general type is known, for example, from German Utility Model No. 1694542.

When heat treating an advancing yarn by means of a godet that advances the yarn, it is necessary that the rotating godet casing have over its entire surface a uniform surface temperature. To this end, the godet is conventionally heated by a radiation heater that is arranged in the interior of the godet and aligned substantially parallel to the godet casing.

Since the yarn loops several times about the godet casing along an axial contact length, it is also necessary that the godet casing have a substantially constant surface temperature along the entire contact length. However, in this connection, major heat losses are usually incurred in the end regions of the godet by thermal conduction or by circulating cooling air.

DE 195 32 036 C1 addresses this problem, and proposes that an adjustable cover be arranged between the radiation heater and the godet casing, so that in the godet casing heating zones are formed, which are more or less intensely heated depending on the adjustment of the cover. However, this arrangement has the considerable disadvantage of poor efficiency, since the cover shields from the godet casing the heat that is permanently generated by the radiation heater.

Likewise, the arrangement disclosed in U.S. Pat. No. 4,880,961 concerns a mode of operation of the radiation heater with poor efficiency, since the heat generated by the radiation heater must penetrate a wall of different thicknesses, so as to heat the godet casing.

Accordingly, it is an object of the invention to provide a godet of the above described type wherein the godet casing is heated by means of radiation heat such that the contact length of the godet has a substantially constant surface temperature.

A further object of the invention is to provide a godet, in which the energy generated by the heater results in heating the godet casing without significant losses.

SUMMARY OF THE INVENTION

The above and other objects and advantages of the present invention are achieved by the provision of a godet which comprises a godet support frame and a drive shaft rotatably mounted to the support frame. A tubular support is fixedly mounted to the support frame so as to coaxially surround the drive shaft, and a casing is fixed to the drive shaft so that the tubular outer wall of the casing is spaced outwardly from the tubular support. A radiation heater, which comprises at least one heating coil, is wound about the tubular support, and the heating coil exhibits different spacings between adjacent windings of the coil so as to provide non-uniform heating along the axial length of the casing.

The special advantage of the invention lies in the fact that the heat may be radiated as a function of the temperature distribution over the length of the godet casing. Thus, the radiation heater may generate a higher level of heat radiation in particular in the end regions of the godet casing. To achieve this result, the radiation heater is constructed with a heating coil which has over its length different spacings between adjacent windings. Thus, the zones that require in the godet casing a greater heat input based on heat conduction, exhibit a relatively small spacing between the windings of the heating coil.

The godet of the present invention permits the realization of any desired temperature profile along the contact length of the godet surface. In this connection, it is possible to predetermine with advantage the heat radiation both by the number of the windings of the heating coil and by the configuration of the spacings between adjacent windings.

A further advantage of the godet in accordance with the invention, resides in the fact that the godet casing is heated both by heat radiation and by convection. In this connection, use is made of the effect that by the rotation of the godet casing, an air current develops within the godet casing in the annular space formed between the godet casing and the radiation heater. This air current leads to a transfer of the energy from the heater to the godet casing by convection. It has been found that in such an arrangement the radiation heater is capable of operating in a range below the normal temperature range from 800 to 1,000° C.

In a further development of the invention, the heating coil of the radiation heater is embedded in a protective tube, which is spirally mounted to the tubular support. This avoids direct contact with the heating coil, for example, while changing a godet casing.

For purposes of embedding the heating coil, it is preferred to have an electric insulation sleeve arranged between the tabular support and the heating coil. This allows the heating coil to be mounted directly to the circumference of the tubular support and so as to be able to release its radiation heat undiminished in the direction toward the godet casing. This embodiment is preferably suitable for heating the godet casing to higher temperatures in a range of 300° C., since the portion of energy transferred by convection is especially large. The air current that is present between the godet casing and the heating coil has direct contact with the heating coil.

To increase the heat energy released by the radiation heater, it is advantageous to provide a reflector arranged between the tubular support and the radiation heater. Furthermore, this arrangement will also limit the heat energy that is released toward the interior. In particular for avoiding high storage temperatures, it is advantageous to position a heat insulation sleeve between the reflector and the support.

In accordance with a further preferred embodiment, an additional radiation heater is arranged on the tubular support opposite to the inner end wall of the godet casing. As a result thereof, an additional heat input is generated both into the outer peripheral region of the godet casing and into its end wall. This additional radiation heater thus inputs a heat energy into the region of the godet which is normally subjected to the greatest cooling.

The arrangement of the present invention has shown that a low surface temperature of the heating coil in a range from 500 to 800° C. will suffice to heat the godet casing to a temperature of about 250° C.

In one embodiment of the invention, a plurality of radiation heaters are provided which are disposed in a serial arrangement along the length of the tubular support. The heaters thus define separate heating zones, and the heaters are independently controllable. This embodiment can be used in particular for godets with a relatively long contact length from about 250 to 300 mm. The heat energy that is differently input into the zones of the godet is directly generated by the independently adjustable radiation heaters.

The heating of the godet casing with several radiation heaters has also the advantage that it permits adjustment of a finely graduated surface temperature and enables a highly sensitive control of the surface temperature with fast recovery times. In this connection, the zones may have identical widths or different widths, with the windings in the heating coils being arranged equally or differently spaced apart from one another within a zone.

It is also desirable to provide a plurality of axially spaced apart annular ribs on the tubular support which are respectively disposed between adjacent heaters. The ribs are radially sized to provide an air gap of a few millimeters between the ribs and the godet casing. As a result, the respectively defined heating zones are heated as a function of the radiation heater associated thereto.

In the above embodiment, it is advantageous to mount a plurality of temperature sensors on the casing in radial alignment with respective ones of the heaters, and with each heater being controlled in a control circuit as a function of the measured temperature. This arrangement offers the possibility of being able to predetermine a temperature profile of the contact length by means of the control system.

The axial lengths of the heaters may be non-uniform. In this embodiment, the heating coils of the radiation heaters have different heating lengths, so that their specific load may be varied. In particular, it is possible to reach in the radiation heaters arranged in the opposite end regions of the godet, which are shorter than the heating coils of the radiation heaters in the center region of the godet, a specific load in a range of about 5 watts per square centimeter.

BRIEF DESCRIPTION OF THE DRAWINGS

Further advantages, features, and applications of the invention will now be described in more detail with reference to the drawings, in which.

DETAILED DESCRIPTION OF THE PREFERRED EMBODIMENTS

Figure 1:
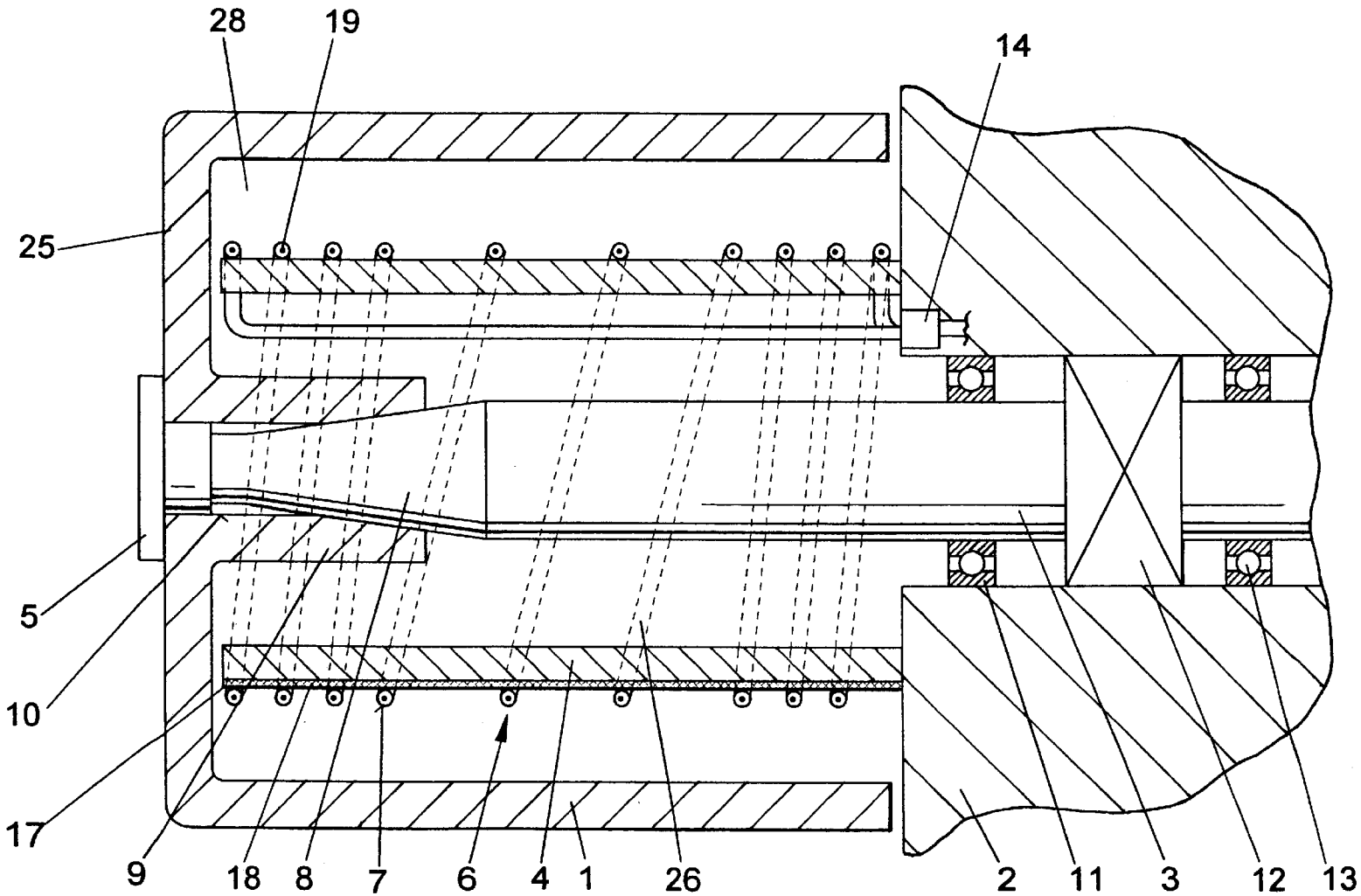
FIG. 1 is a sectioned side elevation view of a godet having a radiation heater in accordance with the present invention.
Figure 2:
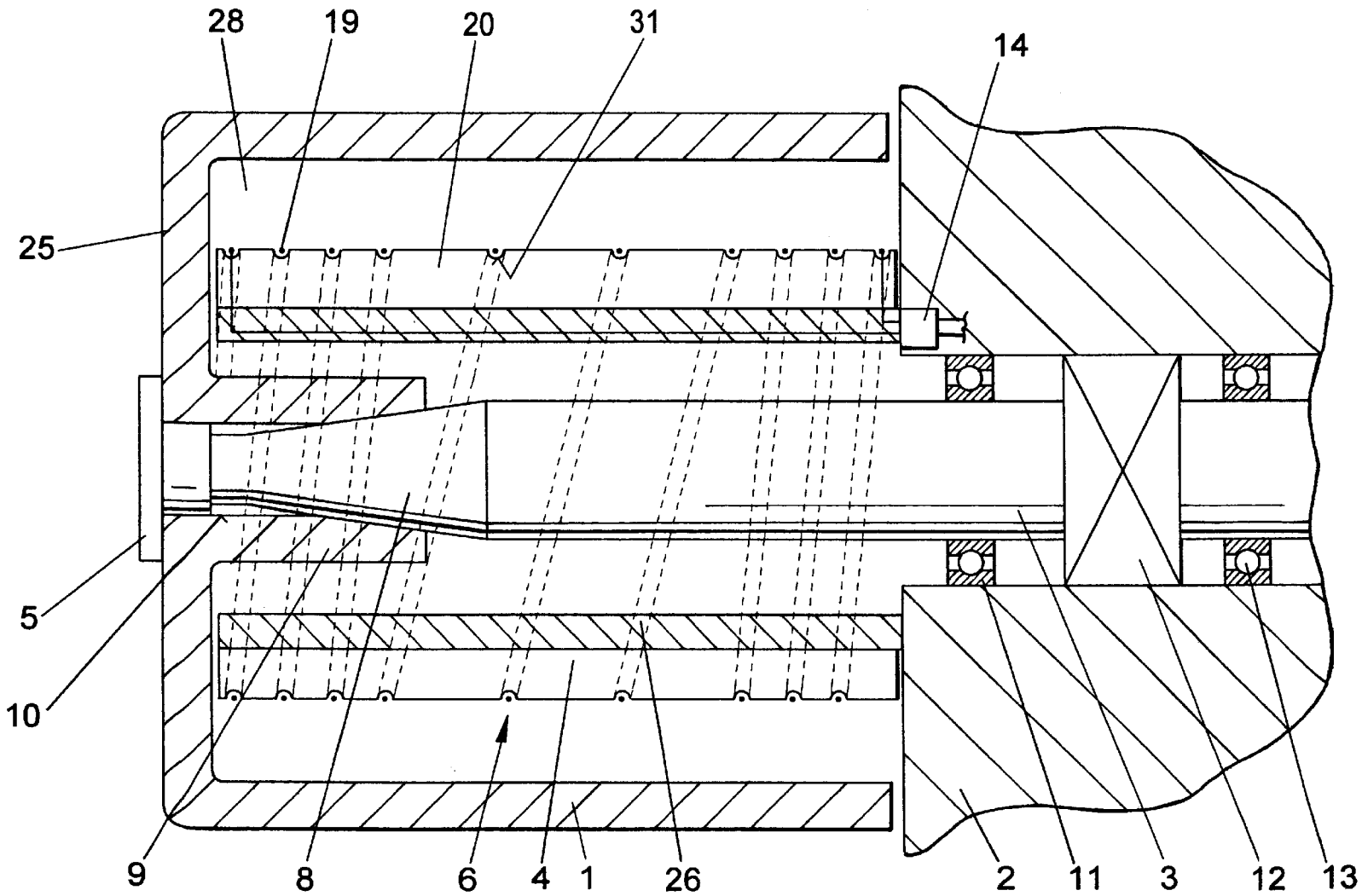
FIGS. 2–4 are views similar to FIG. 1 and illustrating additional embodiments of the invention.

FIGS. 1 and 2 are each a schematic, axially sectioned view of a godet. Unless otherwise specified, the following description will apply to both figures. The godet is mounted on a stationary godet support frame 2, and it includes a drive shaft 3 which is mounted in cantilever fashion to the support frame by bearings 11, 13 so as to rotate about the axis of the shaft. A tubular support 4 is fixedly mounted to the support frame so as to be coaxial with and radially spaced from the drive shaft 3.

The godet further includes a casing 1 which includes a tubular outer wall and an end wall 25. In its center, the end wall 25 is provided with a collar 9 which is coaxial with the outer wall of the casing 1. Through end wall 25 and collar 9 a bore 10 extends, which flares out conically at the end of the collar. Inserted in formfitting manner into bore 10 is the free end of the drive shaft 3 which is in the form of a cone 8. A clamping element 5 secures the end wall 25 and the collar 9 to the cone 8 of the drive shaft 3. The drive shaft 3, with the casing 1 assembled thereto, is driven by a drive 12 which is mounted to the support frame 2.

The tubular support 4 is positioned between the projecting portion of the drive shaft 3 and the godet casing 1, and the godet casing surrounds the shaft in a cup shaped manner.

Both the projecting portion of drive shaft 3 and the collar 9 extend through the tubular support 4, and the free end of the tubular support is spaced from the end wall 25. Likewise, between godet casing 1 and the tubular support 4, an annular space 28 is formed, which accommodates a radiation heater 6. The radiation heater 6 comprises a heating coil 19, which spirals in a plurality of windings 26 around the tubular support 4. The heating coil 19 is connected to a connection 14 arranged on the godet support frame 2. Via connection 14, the radiation heater is supplied with electric power.

In the embodiment shown in FIG. 1, the heating coil 19 is inserted into a protective tube 7. Thus, the protective tube 7 is spirally wound around the tubular support 4 and attached thereto.

The winds of the protective tube 7 with heating coil 19 are wound around the support 4 in such a manner that the axial spacings between adjacent windings are smaller in the end regions of the support than the spacings of adjacent windings in the center region of the support. Between the protective tube 7 and the inside diameter of godet casing 1, a spacing is formed, which is typically sized from 6 to 15 mm. As a result of differently distributing the windings over the heating length of the radiation heater, it is accomplished that the regions of the godet casing which face the regions of the radiation heater with small spacings between windings 26, are heated to a greater extent. Thus, more heating energy is supplied to the regions which are subjected to greater heat losses.

To conduct heat radiation purposefully outward toward godet casing 1, as shown in the lower half of FIG. 1, it is advantageous to arrange a reflector 17 between the protective tube 7 and the tubular support 4. To prevent an excessively large amount of heating energy from reaching the drive shaft 3 and, thus, bearing 11, a layer of heat insulation 18 is arranged between the reflector 17 and the support 4.

In FIG. 2, the circumference of the tubular support 4 mounts an electrical insulation sleeve 20. The insulation sleeve contains in its circumference a spirally extending groove 31. The windings 26 of groove 31 are formed over the length of the support with different spacings between each other. In particular toward the inner end of the godet casing, the windings are arranged with a smaller spacing between one another than in the center region of the godet casing. Inserted into groove 31 is the heating coil 19. Thus, the heating coil 19 has no protective cover toward annular space 28 or godet casing 1. This arrangement permits a substantial increase in the portion of heat that is transferred by convection. The convection in annular space 28 is favored by an air current that is generated by rotating godet casing 1. As a result it is possible to compensate significantly for heat losses that occur at higher rotational speeds due to air currents developing in the peripheral region. Furthermore, energy of the radiation heater is input more efficiently into godet casing 1.

Figure 3:
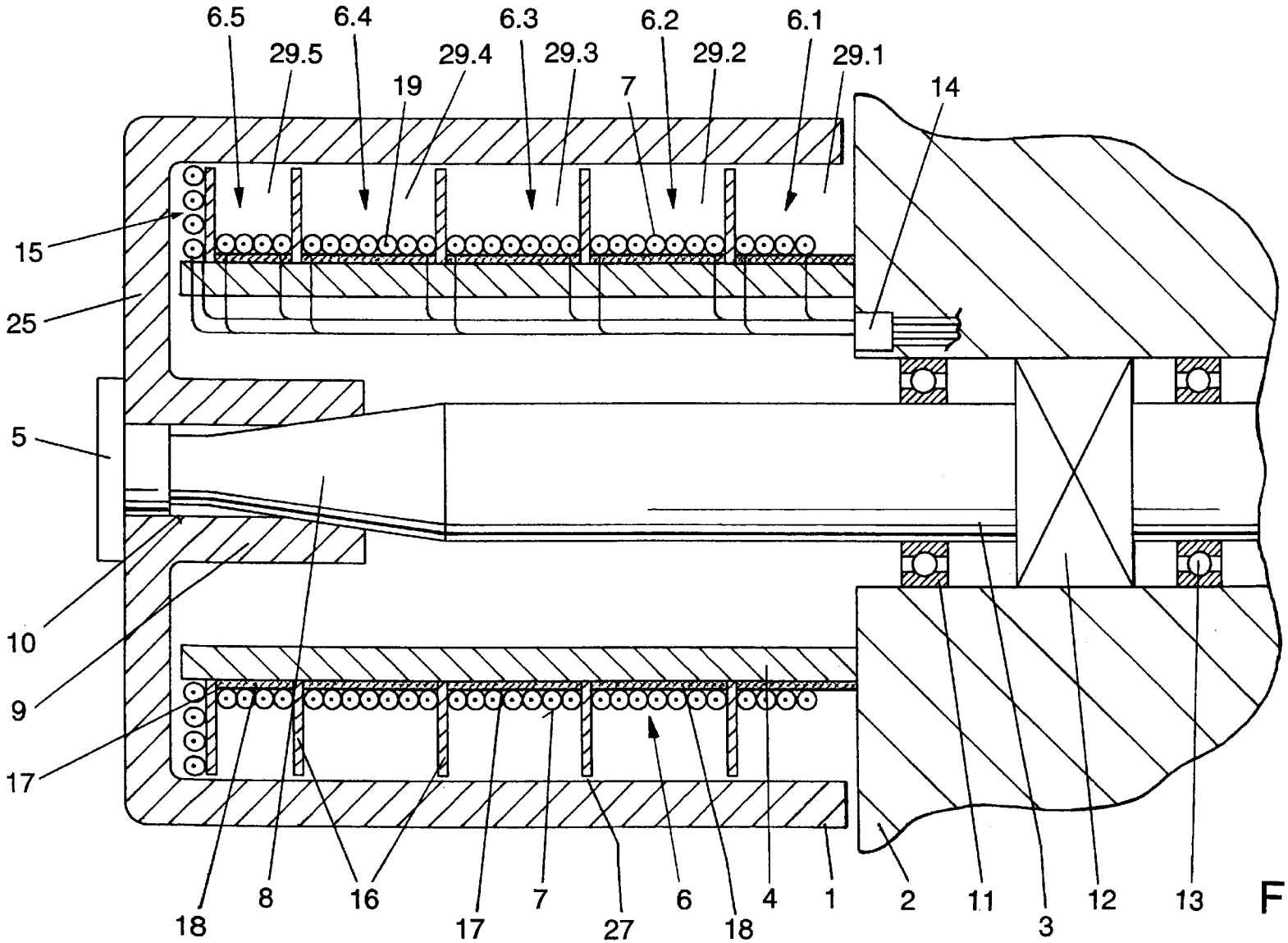
Figure 4:
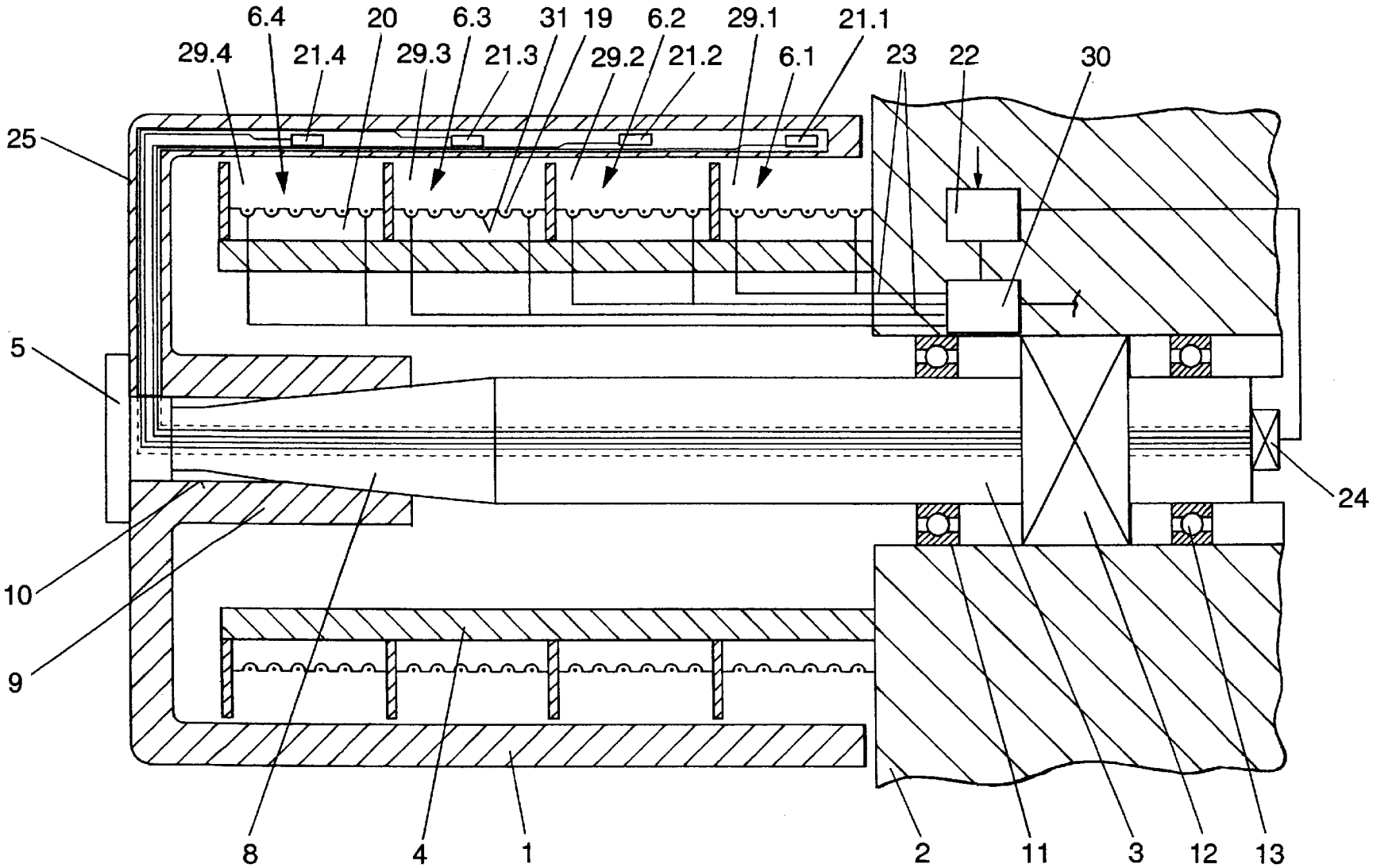

FIGS. 3 and 4 are each a schematic, axially sectioned view of a godet, whose casing is heated by a plurality of serially arranged radiation heaters.

The layout of the godet shown in FIG. 3 corresponds substantially to the layout of the godet shown in FIG. 1, so that the description of FIG. 1 is herewith incorporated by reference. In FIG. 3, the support 4 mounts, in serial arrangement, radiation heaters 6.1, 6.2, 6.3, 6.4, and 6.5. In this arrangement, each radiation heater 6.1–6.5 consists of a heating coil 19, which is embedded in a protective tube 7. The protective tube 7 winds helically around the tubular support 4. Each of the heating coils 19 is connected via connection 14 to an electric power supply unit. The support 4 mounts an annular rib 16 between adjacent radiation heaters 6.1, 6.2 and 6.2. 6.3 and 6.3, 6.4 and 6.4, 6.5. The ribs 16 are arranged in the shape of disks around the support 4, with an air gap 27 being formed between the outside diameter of the ribs 16 and the godet casing 1. The air gap 27 is substantially smaller than the spacing between radiation heaters 6 and godet casing 1 and amounts to only few millimeters.

In the arrangement shown in FIG. 3, the winds of protective tube 7 are equally spaced apart, so that each heating zone 29.1–29.5 that is formed between two adjacent ribs is uniformly heated over the length of heating coil 19. To realize zones which are heated with a higher heating energy on the godet casing, the lengths of the heating coils 19 of individual radiation heaters 6.1–6.5 are different. In the arrangement shown in FIG. 3, the radiation heaters 6.1 and 6.5 are each constructed with short heating coils. As a result, the specific load of the heating coil is increased, so that a larger amount of heating energy is released to the respective heating zones 29.1 and 29.5. The radiation heaters 6.1 and 6.5 are again located in zones, in which greater heat losses are incurred in the godet casing.

The radiation heaters 6.1–6.5 are mounted with their respective protective tubes 7 to the tubular support above a reflector 17 and a heat insulation sleeve 18.

In the end regions of the godet and in particular on end wall 25 of godet casing 1, a relatively great cooling occurs in conventional godets, since the end wall 25 is not heated or only inadequately heated, and since the end wall 25 represents a relatively large heat dissipation surface. To compensate for this cooling effect, the free end of the support 4 mounts an additional radiation heater 15, which is opposite to the end wall 25. Via this additional radiation heater 15, heating energy is supplied primarily to the end region of godet casing 1 and its end wall 25, so as to compensate for the energy dissipation in the aforesaid regions. As a result of this compensation, the region of the outer surface of godet casing 1, which has a substantially constant temperature on its contact length, is enlarged with respect to its length dimension, so that without increasing the constructional overall length of the godet, it is possible to enlarge the contact length on the godet.

In the godet shown in FIG. 4, the support 4 mounts again, in serial arrangement, a plurality of radiation heaters 6.1–6.4. In this embodiment, the heating coil 19 of each heater is embedded in an electrical insulation sleeve 20 that is provided with screw-thread type grooves 31. The electrical insulation sleeve 20 is mounted to the support 4. In like manner, as previously described with reference to FIG. 3, adjacent radiation heaters are separated from one another by annular ribs 16. Each of the thus-formed heating zones 29.1–29.4 is associated with a temperature sensor 21.1–21.4 accommodated in the godet casing. The temperature sensors 21.1–21.4 are connected to a data transmitter 24 arranged at the end of drive shaft 3. The data transmitter 24 transmits measured data between the rotating and the stationary structural components of the godet. The measured data are then supplied to a control device 22, which connects to a control system 30. The control system 30 assumes the control of the energy supply to the radiation heaters 6.1–6.4. Thus, it is possible to control each individual radiation heater as a function of the surface temperature of the godet casing, or to adjust a desired temperature profile along the contact length of godet casing 1.

Such a control has the advantage that material-specific properties, which influence the heat flow, do not affect the desired surface temperature of the godet casing.

In the drawings and specification, there has been set forth a preferred embodiment of the invention, and although specific terms are employed, they are used in a generic and descriptive sense only and not for purposes of limitation.

That which is claimed is:

1. A godet for advancing, guiding, and heating an advancing synthetic filament yarn, comprising a godet support frame, a drive shaft mounted to said support frame for rotation about the axis of the drive shaft, a tubular support fixedly mounted to said support frame and coaxially about said shaft, a casing which includes a tubular outer wall and which is coaxially fixed to said shaft so as to rotate therewith about said axis, and such that the outer wall of said casing is spaced outwardly from said tubular support, and a radiation heater comprising at least one heating coil wound about said tubular support and extending along at least a substantial portion of the axial length of said tubular support, with the heating coil exhibiting over the axial length of the tubular support different spacings between adjacent windings of the coil so as to provide non-uniform heating along the axial length of the casing, and further comprising a heat insulating sleeve interposed between the tubular support and the heating coil.

2. The godet as defined in claim 1 wherein the heating coil is spirally wound about the tubular support.

3. The godet as defined in claim 2 wherein the heating coil is enclosed in a protective tube.

4. The godet as defined in claim 2 wherein the heating coil is wound about said tubular support without a protective cover between the heating coil and the outer wall of the casing.

5. The godet as defined in claim 1 further comprising a reflector interposed between the tubular support and the heating coil.

6. The godet as defined in claim 5 wherein the heat insulating sleeve is interposed between the tubular support and the reflector.

7. The godet as defined in claim 1 wherein said casing further includes a radially directed end wall, and wherein said heating coil includes a plurality of windings mounted on the tubular support directly opposite the end wall.

8. The godet as defined in claim 1 wherein said heating coil is constructed so as to have a surface temperature in a range between about 500° and 800° C.

9. A godet for advancing, guiding, and heating an advancing synthetic filament yarn, comprising a godet support frame, a drive shaft mounted to said support frame for rotation about the axis of the drive shaft, a tubular support fixedly mounted to said support frame and coaxially about said shaft, a casing which includes a tubular outer wall and which is coaxially fixed to said shaft so as to rotate therewith about said axis, and such that the outer wall of said casing is spaced outwardly from said tubular support, and a plurality of radiation heater s disposed in a serial arrangement along the length of the tubular support, with each radiation heater comprising a heating coil wound about said tubular support, and a connection for supplying electric power to each of the radiation heaters, and wherein the lengths of the radiation heaters are non-uniform so that the amount of heating energy provided by the respective radiation heaters is non-uniform.

10. The godet as defined in claim 9 wherein said tubular support includes a plurality of axially spaced apart annular ribs which are respectively disposed between adjacent radiation heaters, and with the annular ribs being spaced a short distance from said casing.

11. The godet as defined in claim 9 wherein the axial lengths of the radiation heaters are non-uniform.

12. The godet as defined in claim 9 wherein the lengths of the radiation heaters in the two end regions of the axial length of the tubular support are shorter than the lengths of the radiation heaters in the medial portion of the axial length of the tubular support.

13. A godet for advancing, guiding, and heating an advancing synthetic filament yarn, comprising a godet support frame, a drive shaft mounted to said support frame for rotation about the axis of the drive shaft, a tubular support fixedly mounted to said support frame and coaxially about said shaft, a casing which includes a tubular outer wall and which is coaxially fixed to said shaft so as to rotate therewith about said axis, and such that the outer wall of said casing is spaced outwardly from said tubular support, a radiation heater comprising a heating coil wound about said tubular support so as to be directly exposed to the outer wall of the casing, and an electrical insulation sleeve interposed between the tubular support and the heating coil.

14. A godet for advancing, guiding, and heating an advancing synthetic filament yarn, comprising a godet support frame, a drive shaft mounted to said support frame for rotation about the axis of the drive shaft, a tubular support fixedly mounted to said support frame and coaxially about said shaft, a casing which includes a tubular outer wall and which is coaxially fixed to said shaft so as to rotate therewith about said axis, and such that the outer wall of said casing is spaced outwardly from said tubular support, and a plurality of radiation heaters disposed in a serial arrangement along the length of the tubular support, with each radiation heater comprising a heating coil wound about said tubular support, and a control for independently controlling each of the radiation heaters.

15. The godet as defined in claim 14 further comprising a plurality of temperature sensors positioned on the casing in radial alignment with respective ones of the radiation heaters, and wherein said control is configured to adjust each radiation heater in response to its associated sensor.

16. The godet as defined in claim 15 wherein said tubular support includes a plurality of axially spaced apart annular ribs which are respectively disposed between adjacent radiation heaters, and with the annular ribs being spaced a short distance from said casing.

17. The godet as defined in claim 16 further comprising a heat insulating sleeve interposed between the tubular support and the heating coil.

* * * * *